US006940469B2

(12) United States Patent
Göttl et al.

(10) Patent No.: US 6,940,469 B2
(45) Date of Patent: Sep. 6, 2005

(54) ANTENNA ARRANGEMENT

(75) Inventors: Maximilian Göttl, Frasdorf (DE); Wolfgang Mummert, Prutting (DE); Walter Staniszewski, Aschau (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/634,984

(22) Filed: Aug. 6, 2003

(65) Prior Publication Data

US 2005/0030250 A1 Feb. 10, 2005

(51) Int. Cl.[7] ..... H01Q 1/12
(52) U.S. Cl. ..... 343/890; 343/891; 343/872
(58) Field of Search ..... 343/890, 891, 343/892, 878, 872

(56) References Cited

U.S. PATENT DOCUMENTS

| | | | | |
|---|---|---|---|---|
| 3,826,340 A | | 7/1974 | Brokaw | 188/1 B |
| 4,143,378 A | | 3/1979 | Darrouzet | 343/854 |
| 4,377,812 A | | 3/1983 | Göbel et al. | 343/872 |
| 5,333,436 A | | 8/1994 | Noble | 52/726.3 |
| 5,880,701 A | * | 3/1999 | Bhame et al. | 343/890 |
| 5,963,178 A | | 10/1999 | Jones | 343/890 |
| 6,388,622 B1 | * | 5/2002 | Jennetti et al. | 343/700 MS |
| 2002/0184833 A1 | | 12/2002 | Jones | 52/40 |

FOREIGN PATENT DOCUMENTS

| | | |
|---|---|---|
| DE | 201 11 727 U1 | 11/2001 |
| DE | 202 05 550 U1 | 8/2002 |
| DE | 101 19 612 A1 | 11/2002 |
| DE | 201 20 367 U1 | 12/2002 |
| DE | 202 18 101 U1 | 4/2003 |
| DE | 203 01 609 U1 | 5/2003 |
| GB | 2 263 581 A | 7/1993 |
| JP | 10126126 A | 5/1998 |
| WO | WO 97/06576 | 2/1997 |
| WO | WO 99/19935 | 4/1999 |
| WO | WO 01/13459 A1 | 2/2001 |
| WO | WO 02/061877 A2 | 8/2002 |

OTHER PUBLICATIONS

Article in the magazine of Kathrein–Werke KG, "Neue Sendeantenne auf dem Säntis, Schweiz," *Die Antenne* (*Dec. 1997*).

* cited by examiner

*Primary Examiner*—Hoang V. Nguyen
(74) *Attorney, Agent, or Firm*—Nixon & Vanderhye P.C.

(57) ABSTRACT

An improved antenna arrangement is subdivided at least into an upper antenna section and at least one lower antenna section. The upper section has a mounting core, the antenna elements and a radome. At least one lower antenna section is axially adjacent underneath the upper section. The lower antenna section is equipped as a service zone which has at least one access opening, which runs in the circumferential direction, to the internal area in the service zone. The radome is held and anchored elastically via at least two damping arrangements, which are offset with respect to one another in the axial direction, and/or via damping device, which are offset with respect to one another.

27 Claims, 13 Drawing Sheets

ANTENNA ARRANGEMENT

FIELD

The technology herein relates to an antenna arrangement.

BACKGROUND AND SUMMARY

By way of example, an article with the title "Neue Sendeantenne auf dem Säntis, Schweitz" [New transmitting antenna at Sǎntis, Switzerland] was published in the magazine for customers of the company Kathrein-Werke KG (December 1997 issue). This article indicates that the transmitting systems comprise transmitting antennas for broadcast radio, television and mobile radio. The high attitude and, associated with this, the extremely low temperatures in winter made it necessary to use a double-walled radome which can be heated, and within which the antenna elements are accommodated.

Comparable antenna devices have been disclosed, although these are generally intended for base stations for the field of mobile radio, so that the radome has a considerably smaller diameter than that in the prior art cited initially.

Prior publications such as these have become known, for example, from DE 202 05 550 U1 or DE 202 18 101 U1. Both prior publications describe a central antenna mount which, according to DE 202 18 101 U1, can also be provided with radially projecting supporting walls, thus forming three sections or 120° angular areas which are offset from one another in the circumferential direction. Conventional antenna devices are mounted in these area, secured to the antenna nylon, and are provided in the factory with a suitable radome, that is to say with their own antenna cover.

The entire arrangement is surrounded by cladding which has a cylindrical cross section, is located on the outside, and which, according to DE 202 18 101 U1, can be formed with a single wall or, according to DE 202 05 550 U1, can likewise be formed with a double wall, as in the prior art cited initially.

The overall physical complexity, including installation on site, but in particular the difficulty in carrying out repairs have been found to be major disadvantages with the last-mentioned antenna systems. Particularly when, for example, components are not just to be replaced but are also intended to be fitted retrospectively, this involves considerable installation effort in order first of all to remove all of the cladding, to retrofit the appropriate components at a high altitude, in order then to fit the cladding once again once the work has been carried out.

An apparatus of this generic type for accommodating sector antennas has been disclosed in DE 101 19 612 A1. The antenna arrangement for holding the sector antennas, and preferably being formed by mobile radio antennas, has a vertically arranged pylon whose upper section has a mounting piece 3 which is formed by a tube. This is an internal mounting tube in the form of a pylon. The sector antennas are mounted on the external circumference of this mounting tube. An enveloping tube which is mounted on the pylon and through which electromagnetic radiation can pass is then provided for the entire arrangement, comprising the internal mounting tube and the sector antennas which are attached to it. This is what is referred to as the radome. The enveloping tube in this case merges without any discontinuities into a vertical tube which forms the lower section of the pylon. The actual pylon thus forms a step transition from the lower vertical tube with a larger diameter to the upper tubular piece of wire with a thinner diameter, with apertures being provided at the step transition formed in this way, through which the cables which lead to the sector antennas are routed.

Since the lower vertical tube which is provided with the large diameter merges without any discontinuities into the upper developing tube, the entire antenna arrangement appears to be effectively clad and concealed.

Another major disadvantage which has been found with the prior art of the generic type, as well, is that, at certain relatively high wind speeds, the entire antenna pylon can resonate in such a way that the radome is fractured.

The exemplary illustrative non-limiting implementations herein overcome the disadvantages of the prior art and provide an improved antenna arrangement.

In fact, it must be regarded as surprising that the exemplary illustrative non-limiting implementations results in a very highly robust antenna arrangement which is in the form of a pylon, with all of the antenna systems being concealed in a tubular radome which can be designed to be extremely thin. This radome can preferably—as with other known systems as well—have a cylindrical cross section, but may also have any other desired horizontal cross section, for example being polygonal with n sides, or being oval etc. Furthermore, the exemplary illustrative non-limiting antenna arrangement is distinguished by having a service zone in which all the relevant adjustment and connection measures can be carried out, without having to dismantle the entire antenna pylon or else having to remove just the entire radome in advance in order to gain access to the components located underneath it.

Furthermore, the exemplary illustrative non-limiting antenna arrangement has a damping device which ensures that the antenna structure, and in particular the radome, cannot resonate at an appropriate wind speed, thus destroying the system or parts of it.

The exemplary illustrative non-limiting antenna system can be constructed such that, underneath the radome, it has antenna elements which, by way of example, transmit directionally in at least two sectors, preferably in three or more sectors. Any desired antenna element devices can be used in this case, which can transmit even with widely differing horizontal beamwidths, for example with a 3 dB beamwidth of 90°, a 3 dB beam width of 60–65°, etc.

Single-polarized, dual-polarized or else circular-polarized antenna elements can be used. Even what are referred to as x-polarized antenna elements and antenna element arrays can be used, whose polarization directions are aligned at angles of +45° and −45° with respect to the horizontal plane or with respect to a vertical plane.

The exemplary illustrative non-limiting antenna arrangement may also have broadband or narrowband antennas and antenna elements. This structure can be designed such that the entire antenna arrangement transmits and receives in only one band or in a number of bands, for example, in two bands. The band structure may also be a broadband structure, such that it covers, for example, not only the 1800 MHz band for example, but also, for example, the 1900 MHz band (as is normally used in the USA) and/or the UMTS band at about 2000 MHz.

The exemplary illustrative non-limiting antenna arrangement and the compact construction furthermore for the first time make it possible to construct an antenna device such as this effectively as an omnidirectional antenna by means of appropriate interconnection in the service zone. In this case, the antenna elements can preferably be adjusted to have a different transmission angle with respect to the horizontal plane, by means of a down-tilt device which can be controlled remotely.

What is referred to as the service zone is preferably located underneath all the antenna elements. In this case, the service zone is preferably constructed such that, when it is in the closed state, it effectively represents an extension to the radome which surrounds the antenna elements. For this purpose, the service zone may have a corresponding housing framework at a suitable axial height and with an appropriate diameter, which has sufficiently large opening in order to provide access to the internal area here. The opening areas can be closed and covered by individual coverage caps or by housing shells which surround the entire antenna pylon, which are preferably located at least approximately in the same circumferential plane as the radome which surrounds the antenna elements, so that, from the outside, this preferably results in a structure in the form of a pylon whose overall surface is a smooth and continuous as possible, without any evidence as to whether any components are accommodated in the interior of this structure and, if so, what components are accommodated there.

The service zone is constructed such that it can be mounted on the blunt head of a pylon, at which the necessary antenna cables which lead to the antenna device end at an interface which is formed in this way. This blunt pylon is to this extent also referred to in the following text as the pylon foot, pylon base or else as the antenna foot or antenna base. When the service zone is open, the appropriate intermediate cables can be installed, thus producing an electrical connection from the cables which end in the antenna foot to the connecting points, which are provided in the upper area of the service zone, for the cables which lead to the antenna elements. Any desired necessary components such as amplifiers etc. can likewise be accommodated in these service zones. The amplifiers may, for example, be what are referred to as TMAs, TMBs etc. Some of the amplifiers or other circuits which also, for example, develop heat which must be dissipated to the outside can be designed and arranged such that a portion of the amplifier housing is at the same time used as a covering cap closing arrangement for the opening in the service zone, so that these devices can optimally emit the heat produced by them to the outside (some of the devices which produce heat thus represent a portion of the outer casing of the antenna arrangement). Since these amplifiers are now located closer to the actual antenna elements (and no longer in a separate base station), not only does this reduce the number of cables which need to be laid from the base station to the antenna elements, but the power which is required for the amplifiers in the antenna arrangement can also be reduced, for example by a factor of 2. Finally, it is possible to reduce not only the number of electrical cables and glass fiber cables which are used but also, possibly, to reduce the diametric cross section that they need to have. The down-tilt adjusting devices which can be remotely controlled, for example motor units which can be driven approximately, can also be accommodated, for example, in the service zone and then drive the plastic shifters (which are located within the radome) in order to set the different down-tilt angles, for example via a transmission linkage.

However, if necessary, not just one but also a second or three or more service zones which are arranged axially one above the other can be provided, and these can also be retrofitted as required as autonomous modules. A single service zone, which is created in the factory, can just as well be provided having, for example, an axially greater height and, in consequence, itself always providing sufficient space to allow additional components to be accommodated, even retrospectively.

The service zone can preferably be fixed and detached via bolt connections such that, even in a state when it is secured by the bolt connection, the service zone, and hence the pylon structure which is located above it, can carry out an axial rotary movement. This allows the antenna elements to be aligned appropriately.

BRIEF DESCRIPTION OF THE DRAWINGS

These and other features and advantages will be better and more completely understood by referring to the following detailed description of exemplary non-limiting illustrative embodiments in conjunction with the drawings of which.

DETAILED DESCRIPTION

Figure 1:
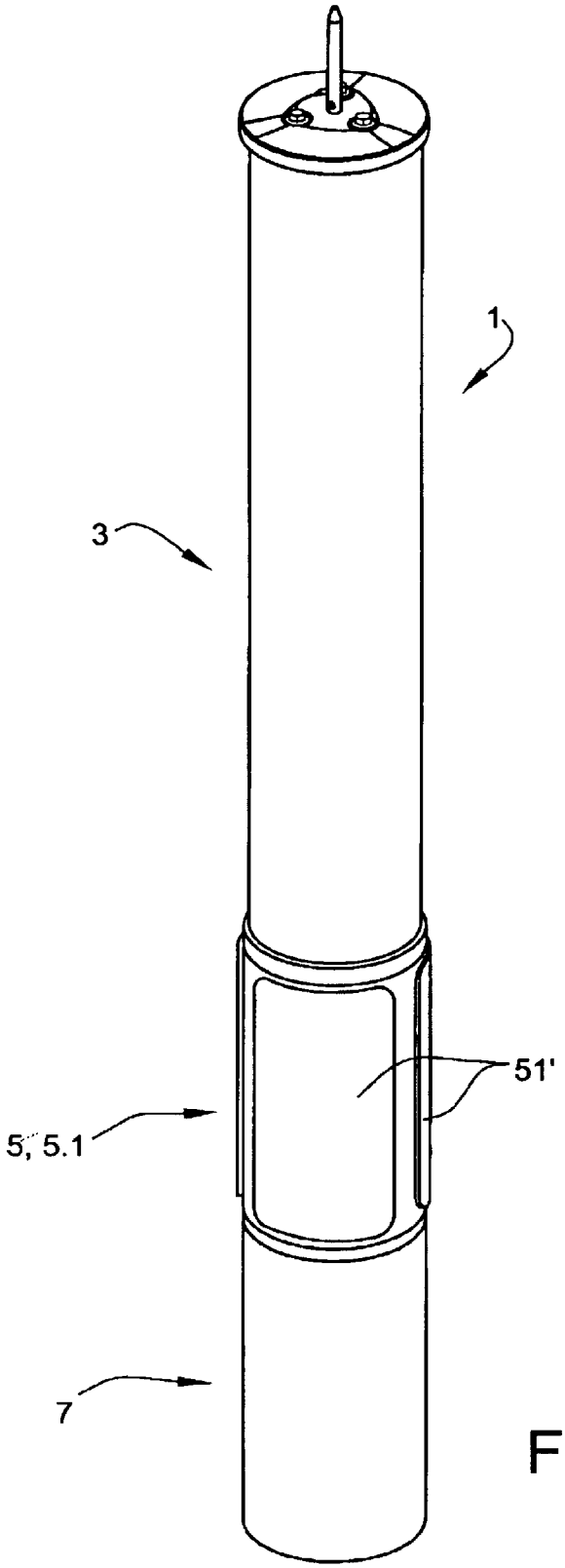
FIG. 1 shows an overall view of an exemplary illustrative non-limiting antenna in the form of a pylon.

FIG. 1 shows an exemplary illustrative non-limiting schematic perspective illustration of an antenna arrangement 1 as may be used in particular as a mobile radio antenna for a base station.

The antenna arrangement 1 has an antenna section 3 which is located at the top, and at least one further antenna section 5 which is located underneath it and has at least one service zone 5.1.

The entire arrangement comprising the upper antenna section 3 and the lower antenna section 5 which is axially adjacent to it is constructed and mounted on an antenna stand device 7, which is used as an antenna base 7. This antenna base 7 need not necessarily be in the form of a pylon as shown in FIG. 1 et seq, but may also have a large or smaller diameter or a different cross-sectional shape, or may, for example, also be in the form of a connecting point at ground level, on which the antenna arrangement 1 is then mounted with the at least upper antenna section 3 and the at least one lower antenna section 5.

Figure 1A:
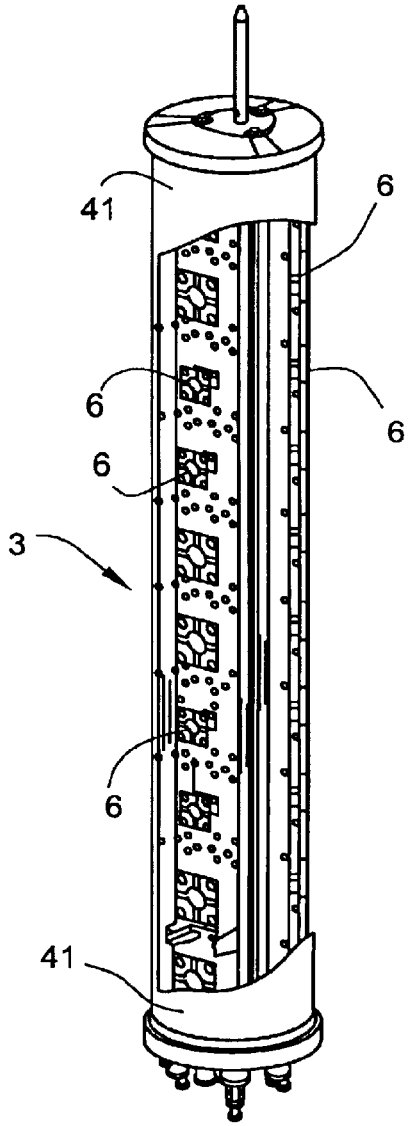
FIG. 1*a* shows an exemplary illustrative non-limiting antenna in the form of a pylon, without a service zone, with parts of the radome not being shown, in order to illustrate the antenna elements located underneath it.

FIG. 1*a* in this case shows the antenna section 3 with the radome 41 partially omitted, in order to show the antenna elements 6 which are located underneath it and which, in the illustrated exemplary non-limiting implementation, are each arranged offset one above the other in the vertical direction, in a number of columns arranged offset in the circumferential direction.

Figure 2:
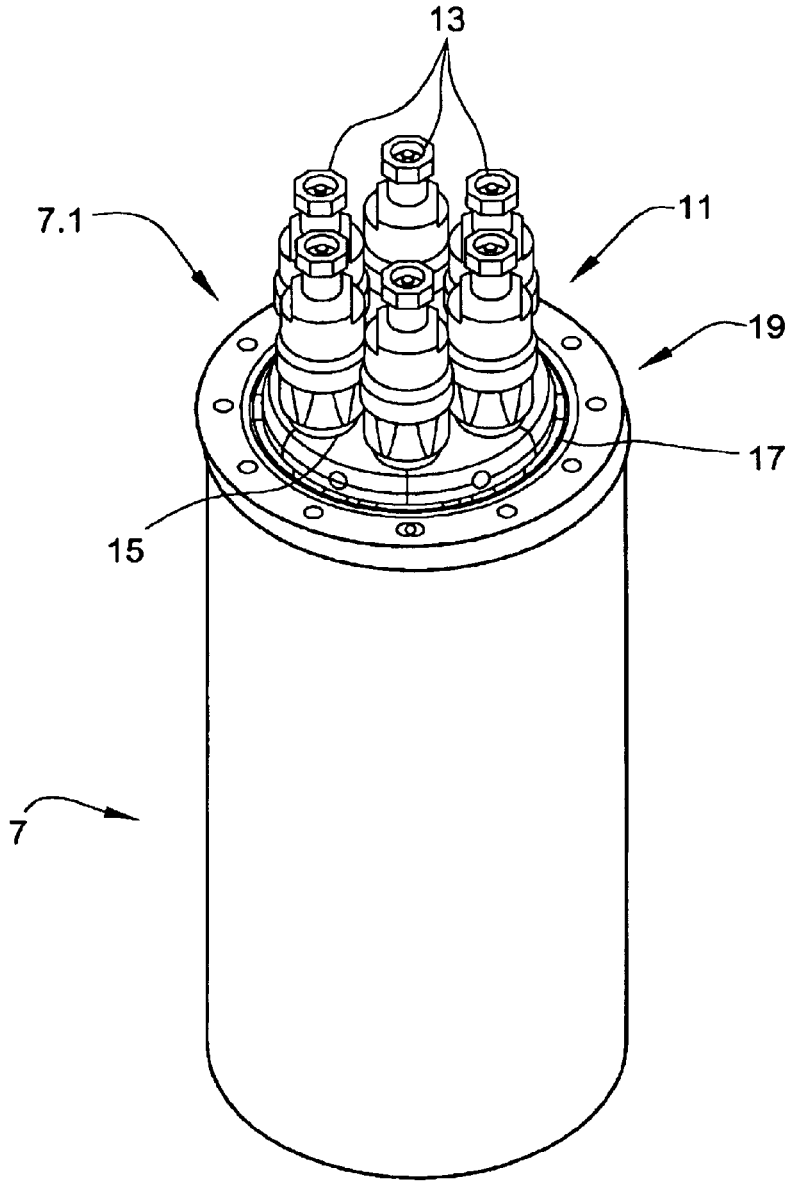
FIG. 2 shows a exemplary illustrative non-limiting prepared antenna foot, on which an antenna system in the form of a pylon is constructed.

FIG. 2 shows the antenna base 7 which, in the present case, is cylindrical and is generally installed on site. This antenna base is firmly anchored on or in the ground. The connecting lines 11 which are required for operation of the antenna are passed through this antenna base itself and preferably end in the area of the upper end of the antenna base 7, where they are preferably each provided with a connecting unit, in particular a connecting plug connection unit 13.

These connecting plugs 13 are held by means of a holding and strain-relief device 15 in the area of the upper end of the antenna base 7, which is provided with an outlet, aperture or access opening 17.

Figure 3:
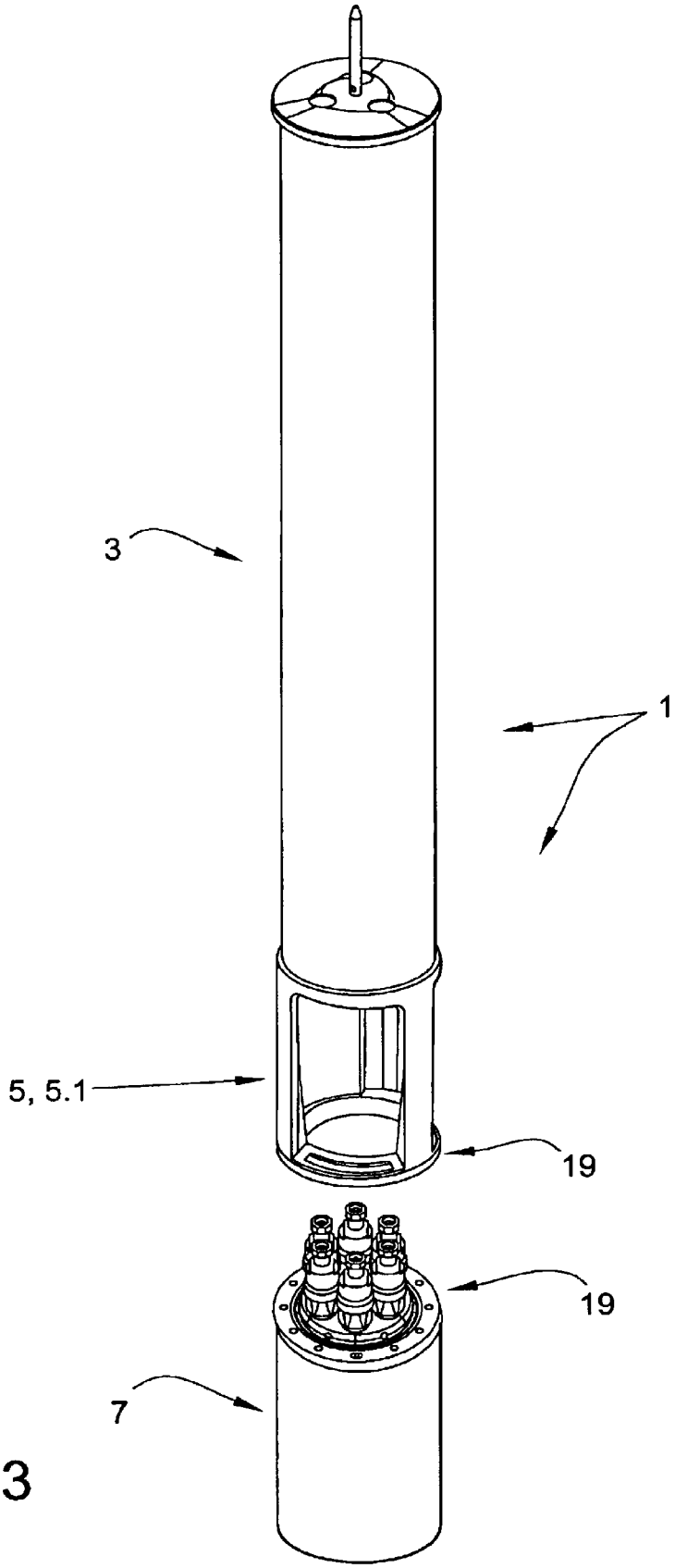
FIG. 3 shows an illustration corresponding to FIG. 1, but with the service zone open and before mounted on the antenna base.

The upper end of the antenna base 7 which as been explained can to this extent also be regarded as an interface 19, on which the antenna arrangement 1 (which is normally prefabricated by the manufacture) is then fitted directly mechanically, and is firmly connected to the antenna base 7 (FIG. 3).

In the exemplary illustrative non-limiting implementation, the cross-sectional shape and the cross-sectional size in the area of the antenna base 7, of the explained lower antenna section 5 with the at least one service zone 5.1 provided there, and of the upper antenna section 3 are the same or essentially the same. In the present case, this means that the diameter is in each case circular and the external dimensions are in this case in at least the same order of magnitude, that is to say in the present exemplary illustrative non-limiting implementation they should differ from one another by less than 20%, in particular less than 10% and above all less than 5%, as well. This gives the impression of a continuous pylon structure without it being immediately evident what the function of this pylon is and whether specific components are accommodated in the interior.

Figure 4:
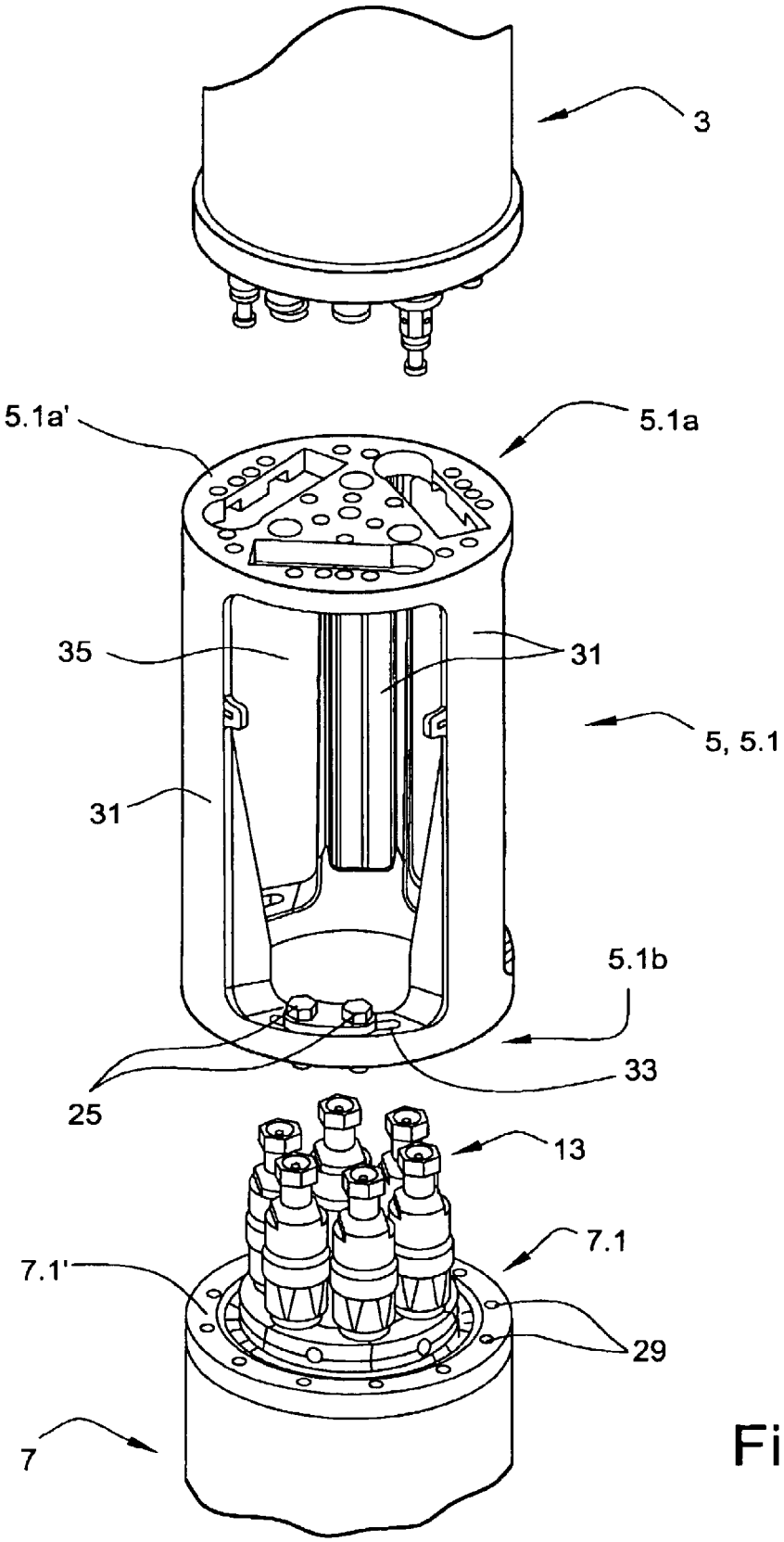
FIG. 4 shows an exploded illustration of the exemplary illustrative non-limiting antenna arrangement and of its major components illustrate in a rather perspective form from top to bottom.
Figure 5:
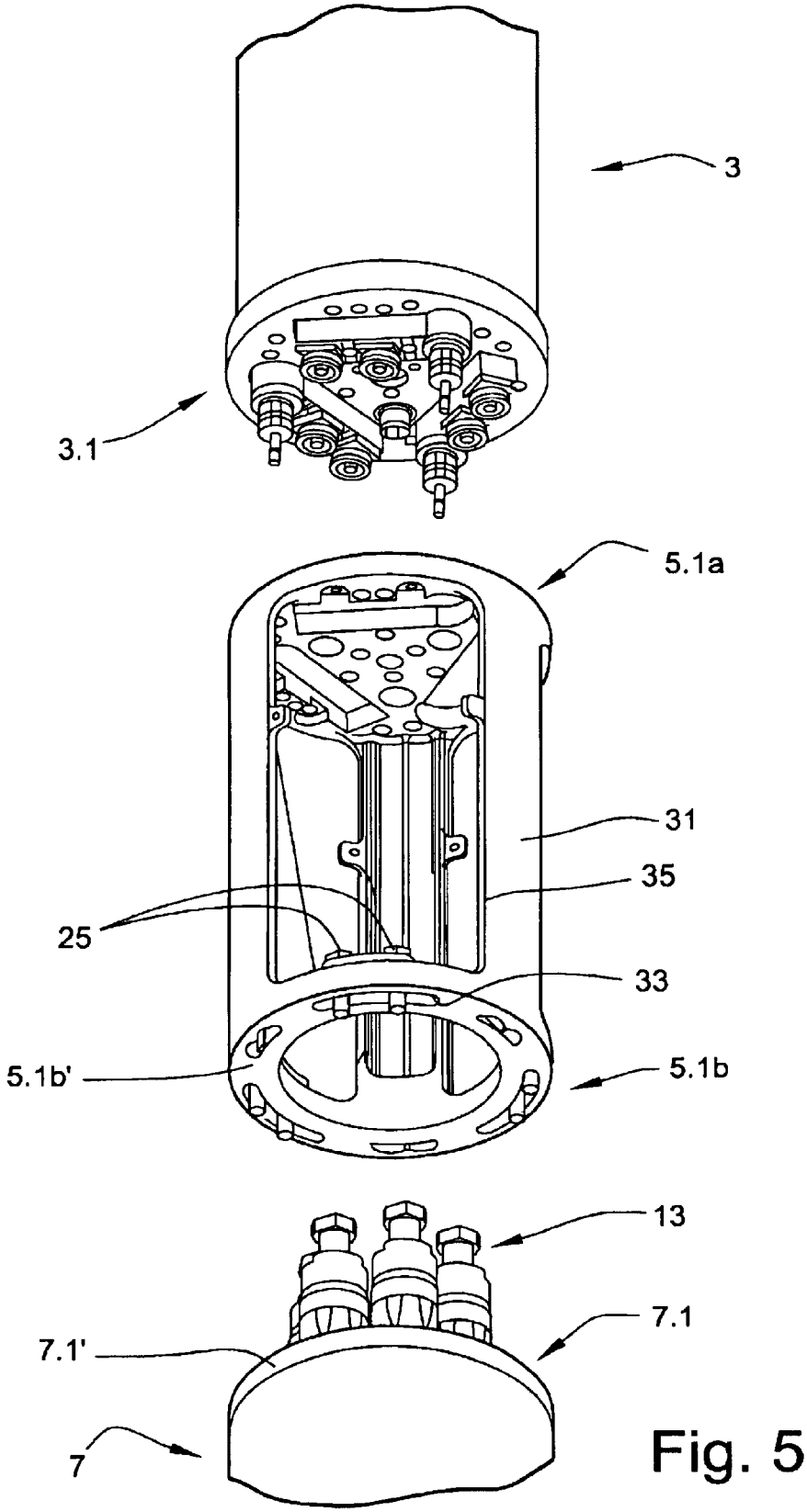
FIG. 5 shows an exploded illustration corresponding to that in FIG. 4, but looking in an upward direction from underneath.

FIG. 4 shows the major components of the antenna arrangement between the antenna base 7 and the lower part of the upper antenna section 3 in the form of an exploded illustration (looking in the direction rather from the top to the bottom), and FIG. 5 shows the components at a corresponding viewing angle, but from the bottom upwards. As can be seen from these figures, the service zone 5.1 which has been explained has a cylindrical plan shape in the illustrative exemplary illustrative non-limiting implementation, to be precise with an upper and a lower end or connecting face 5.1*a* and 5.1*b*.

At the lower connecting point 5.1*b*, the service zone 5.1 can be firmly connected by means of bolts 25 to the top connecting face 7.1 of the antenna base 7.

A connecting face 3.1 is likewise provided on the lower face of the upper antenna section 3, via which the upper antenna section 3 can likewise be mounted on the lower antenna section 5, which is located underneath it, preferably once again by means of a bolt connection 27. The bolt connections which have been mentioned for firm connection of the lower face 3.1 of the upper antenna section 3 to the service zone 5 are produced by means of bolts.

As can be seen from the enlarged detailed illustration in FIGS. 4 and 5, the top connecting face 7.1 has a material ring 7.1' which can be placed on the tubular outer structure of the antenna base 7, or may be part of this tubular antenna base 7. The tubular structure of the antenna base 7 in the end bears all the weight of the antenna arrangement 1. A large number of threaded holes 29 are introduced, offset in the circumferential direction, for fixing at the connecting point 7.1. The service zone 5.1 to be fitted to it has a structure with a top and a bottom connecting ring 5.1*a*' and 5.1*b*' in order to absorb the bearing forces of the upper antenna section 3, and these connecting rings 5.1*a*' and 5.1*b*' are firmly connected in the illustrated exemplary illustrative non-limiting implementation via three material webs 31 which are offset outwards from the central axis.

Figure 6:
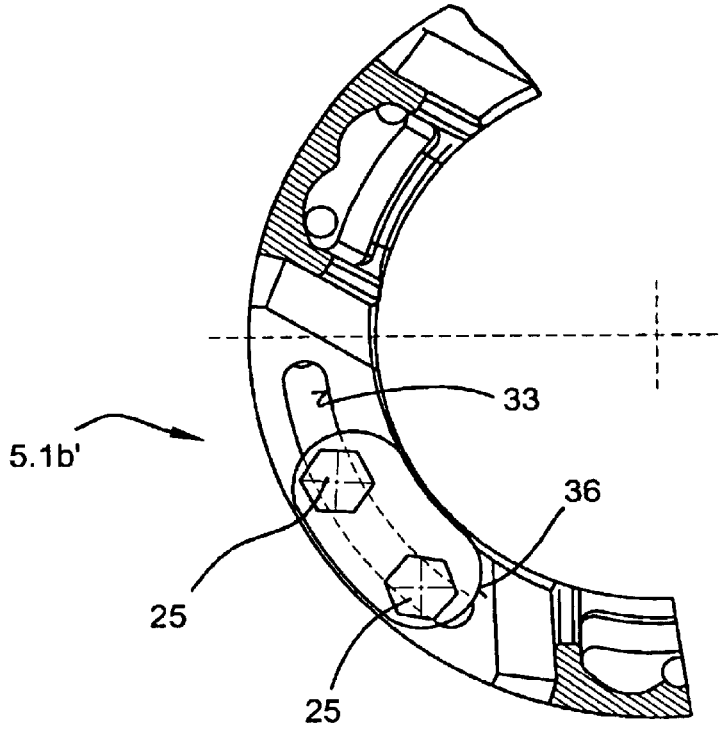
FIG. 6 shows an enlarged perspective detail illustration in order to explain how the exemplary illustrative non-limiting service zone is mounted on the antenna foot.
Figure 7:
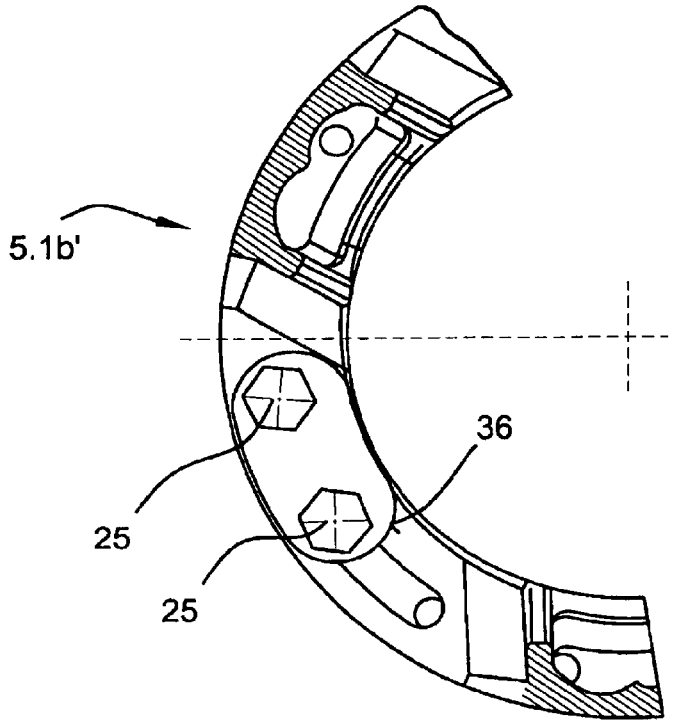
FIG. 7 shows an illustration corresponding to FIG. 7, once the service zone together with the pylon structure resting on it has been rotated through a certain angle.

As can be seen from the enlarged illustration in the form of a section in FIG. 6, elongated holes 33 are incorporated in the illustrated exemplary illustrative non-limiting implementation in the bottom connecting ring 5.1*b*', have a circular shape and are designed to be at least sufficiently large than two bolts 25 can be screwed into the threaded holes 29 in the connecting ring 7.1*a*' in the elongated hole 33, corresponding to the angular separation between the threaded holes 29. The screwheads are in the case supported directly or via washers, for example a common washer 36, on the connecting ring 5.1*b'*, since they have a larger diameter and cannot pass through the elongated hole 33. In other words, the elongated hole 33 is designed to have a width such that only the bolt shank of the bolts 25 can pass through this elongated hole 33. Since, in the present case, the service zone 5.1 has three material webs 31 which are offset at equal angular intervals in the circumferential direction, this results in three radial access openings 35, whose significance will be explained in the following text. In a corresponding way to this configuration, three elongated holes 33, which are seated in the area of the respective access opening 35 in the circumferential direction, are also formed in the bottom connecting ring 5.1*b'*. These elongated holes are used to make it possible in the end to secure the antenna in different angular alignments. This is because the bolt 25' which is located on the left in the elongated hole can, for example, be undone and removed in each elongated hole, with the bolt 25' which is located on the right in each elongated hole being undone only slightly. In this position, the service zone 5.1 can then, for example, be rotated in the anticlockwise direction about is vertical central axis 26 along the illustrated arrow 28, until the bolt 25" which has been mentioned and which passes through the right-hand end of the elongated hole then comes to rest at the respective left-hand end of the elongated hole 33 (FIG. 7). A new bolt can in each case then be screwed into the free thread on the right-hand side in the elongated hole 33, and the bolt on the left-hand side can be removed. The entire pylon can thus be rotated completely about its vertical central axis 26 in a secured position.

The mounting structure for the upper antenna section 3 will be explained in the following text.

Figure 8:
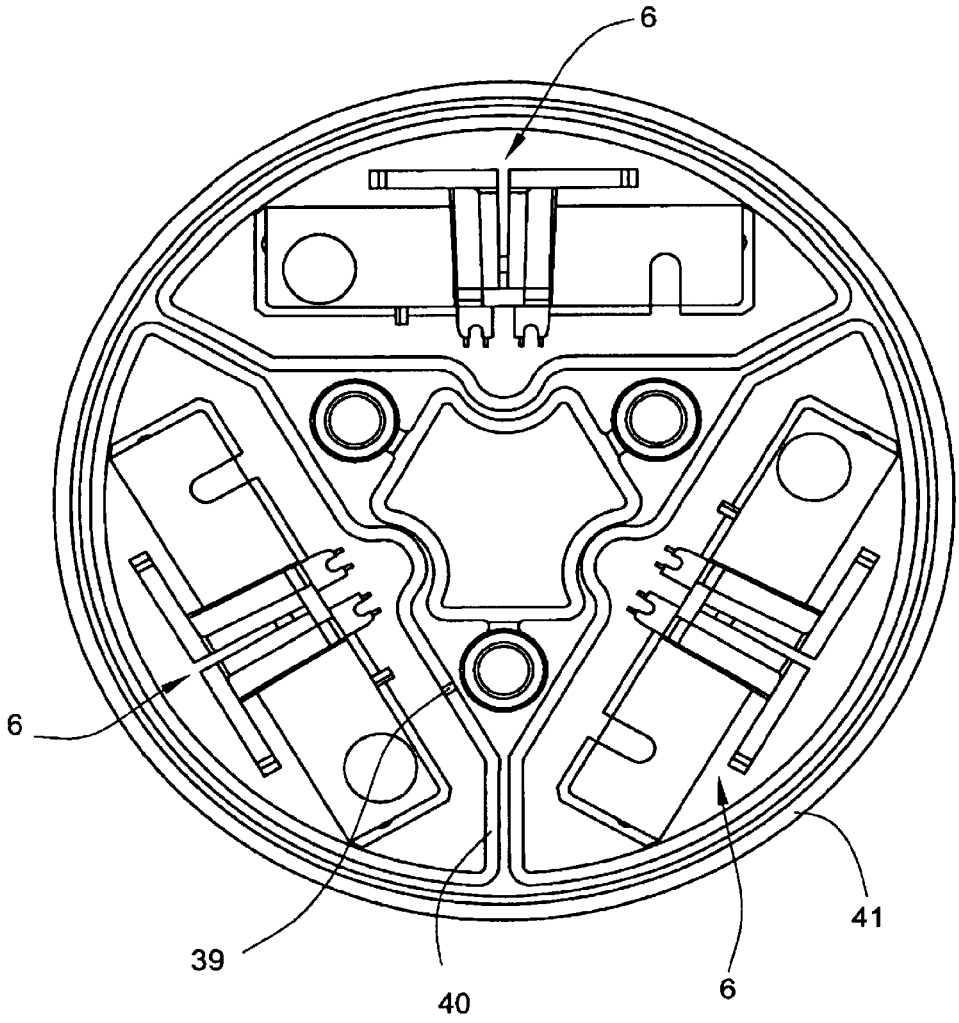
FIG. 8 shows a cross-sectional illustration through the pylon structure with the antenna elements seated internally.

As can be seen in particular from the cross-sectional illustration shown in FIG. 8, the upper antenna section has a central mounting core 39 which, in the illustrated exemplary illustrative non-limiting implementation, preferably has a triangular cross section, with webs or ribs 40 which run radially outwards being adjacent to the corner areas of this structure with a triangular cross section. However, these ribs or webs are not absolutely essential. They may also be omitted or may be replaced by other design measures. This mounting core 39 can be made from any desired material, for example from metal (in some circumstances, also in the form of an extruded part), from plastic or, for example, from fiber glass etc. In principle, widely differing materials may be used. The antenna elements 6 are arranged offset one above the other in the vertical direction between the ribs 40.

The radome 41, which is cylindrical in the illustrated exemplary illustrative non-limiting implementation, is then connected to the webs which project radially outwards. The radome is composed of a material which allows the electromagnetic waves to pass through, preferably without any attenuation or with only a small amount or very small amount of attenuation. Fiber glass is one suitable material for this purpose. The mounting core 39 and the radome 41 may also be formed integrally, that is to say be made overall of a material which allows the electromagnetic waves to pass through it, preferably fiber glass. However, the radome 41 may also be separated from the internal mounting core 39, with projections or grooves, which hold the radome 41 such that it cannot rotate, then preferably being provided on the inner circumferential surface of the radome 41, in the area of those ends of the ribs or webs 40 (which have been mentioned) which are located radially on the outside. In order now to avoid unacceptable resonance, which may possibly destroy the entire arrangement, at specific winds speeds, the upper antenna section 3 is designed such that the radome 41 is held via a damping arrangement 43 located at the top and via damping arrangement 43 located at the bottom, clamped in with a force which can be set or defined in advance, to be precise with the interposition of a damping device 45.

Figure 9:
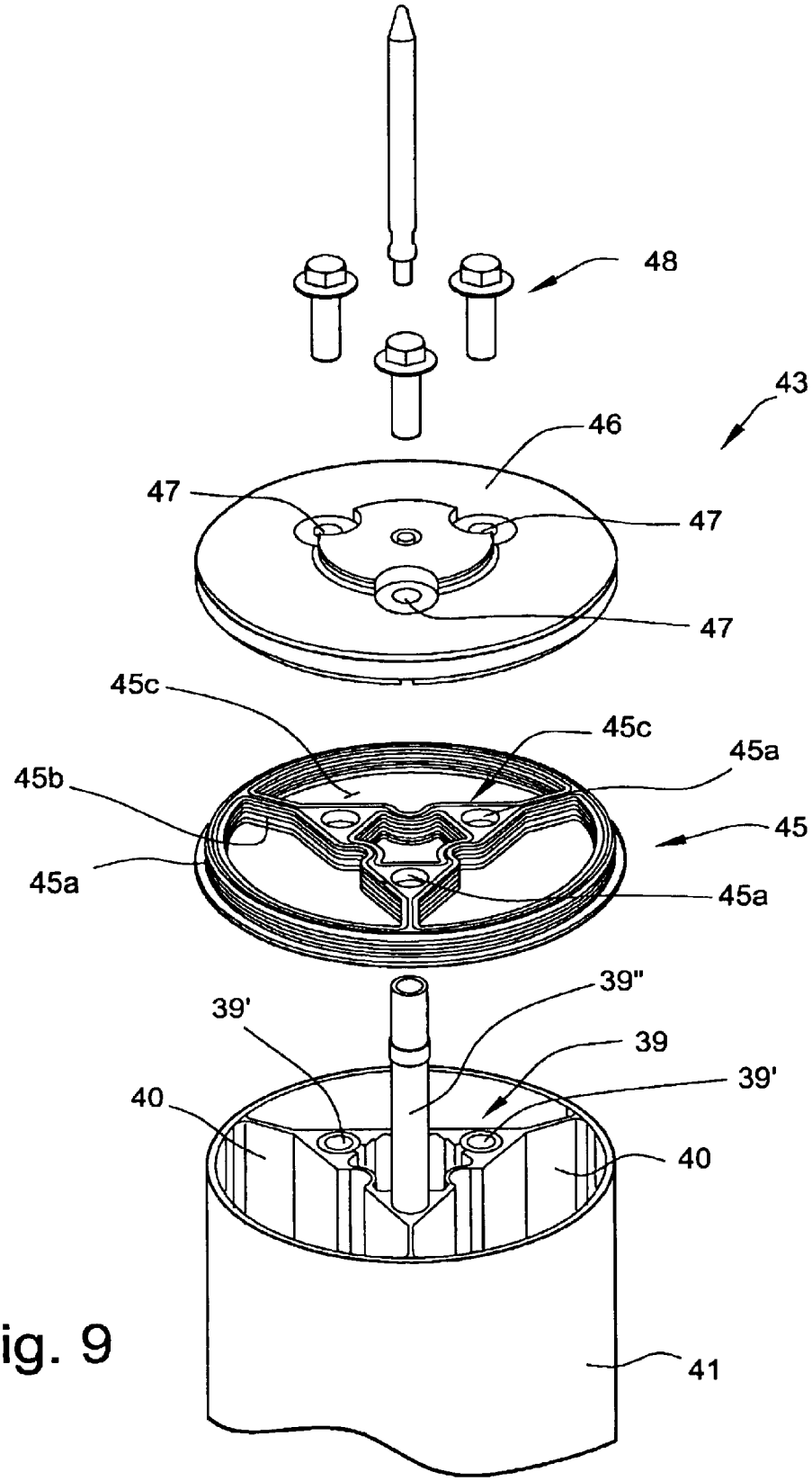
FIG. 9 shows a perspective illustration of an exemplary illustrative non-limiting damping device at the upper end-face end of the pylon structure, including the cylindrical radome.

By way of example, FIG. 9 shows the upper end of this structure in the form of an exploded illustration. As can be seen from this figure, three vertical holes 39' are provided in the triangular structure on the mounting core 39, through which holes 39' tie rods 39" are passed, using spacers, with the spacers being used to prevent the tie rods 39" from being able to interact with, or strike against, the inner wall of the hole 39'. In FIG. 9, two of the elongated holes 39' are in this case also shown without the tie rod 39" inserted. A tie rod 39" has already been inserted only into the hole 39' which is located right at the front in FIG. 9, still projecting axially upwards, that is not yet having been completely inserted into the hole 39'. The damping device 45, which is part of the damping arrangement 43, is shown in FIG. 9 and is preferably composed of an elastomer material, is then placed onto the end-face upper end of this structure. As is shown in the illustration in the form of a section in FIG. 10, the damping device 45 surrounds at least the upper edge 41*a* of the radome 41. The fitting of the upper pressure absorber 46, which is in the form of a cover, with the interposition of the damping device 45 which has been mentioned then results in pressure being applied by the damping element 45 to the radome 41 blot in the radial direction and in the axial direction, by bolts 48 being screwed in through corresponding holes 47 in the upper pressure absorber 43, which is in the form of a cover, and being screwed into end-face holes in the tie rod 39' (which have been mentioned) which pass through the holes 39=in the mounting core 39.

Figure 10:
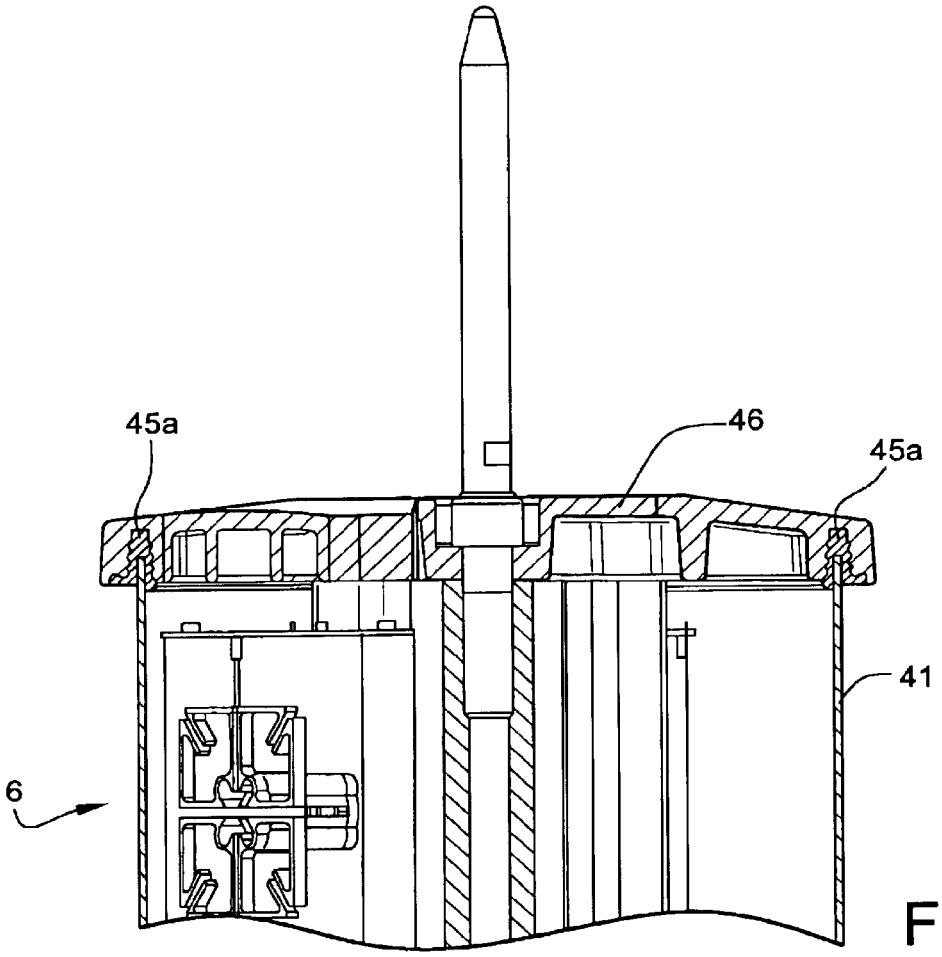
FIG. 10 shows a cross-sectional illustration through the top end-face cover with the damping device, for a modified exemplary illustrative non-limiting implementation of the radome.

In the design shown in FIGS. 9 and 10, the entire pressure absorber 46 which is in the form of a cover in this case has pressure applied to it via the damping device 45 by means of an appropriately shaped damping device 45 not only with the external cylindrical radome 41 but also with the internal mounting core 39, including the webs 40 which run outwards, for which reason the damping device 45, that is to say the corresponding damper element, has an annular section 45*a* which can be placed onto the upper edge of the radome, has three sections 45*b* (underneath which the webs 40 of the mounting core come to rest) which are offset in the circumferential direction and run radially inwards, and has a damping section 45*c* in the center, which damping section has one or more parts and likewise has openings 45*d* incorporated in it once again at the points underneath which the holes 39' are located in the mounting core 39. The holes 39' in the mounting core are thus aligned with the openings 45*d* in the damping device 45 and with the holes 47 in the pressure absorber 46 which is in the form of a cover, so that the bolts 48 (FIG. 9) which have been mentioned can be screwed in via them through the aperture openings and holes that have been mentioned, to be precise into the end-face internal thread in the tie rods 39" which pass through the holes 39'. To this extent, the damping device 45 may be formed as one part, integrally or as two or more parts on each end face for the purpose of holding for the radome 41 with damping.

Figure 11:
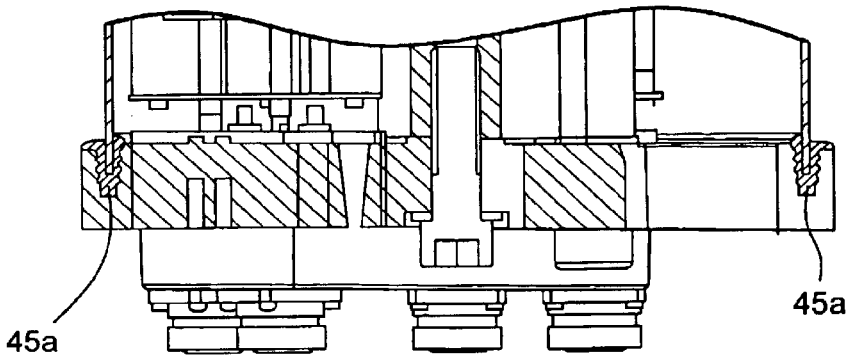
FIG. 11 shows a vertical illustration in the form of a section in the area of the lower end of the radome, at the junction to the adjacent service zone.

The lower face is designed in a corresponding manner (FIG. 11). Overall, the design is chosen such that the damping material is prestressed within a predefined range, within certain limits, by tightening the bolts 48 which have been mentioned, with this prestressing also producing the desired damping for the entire structure at appropriately high windspeeds and thus reliably preventing the resonance which has a destructive effect overall on the system.

Figure 12:
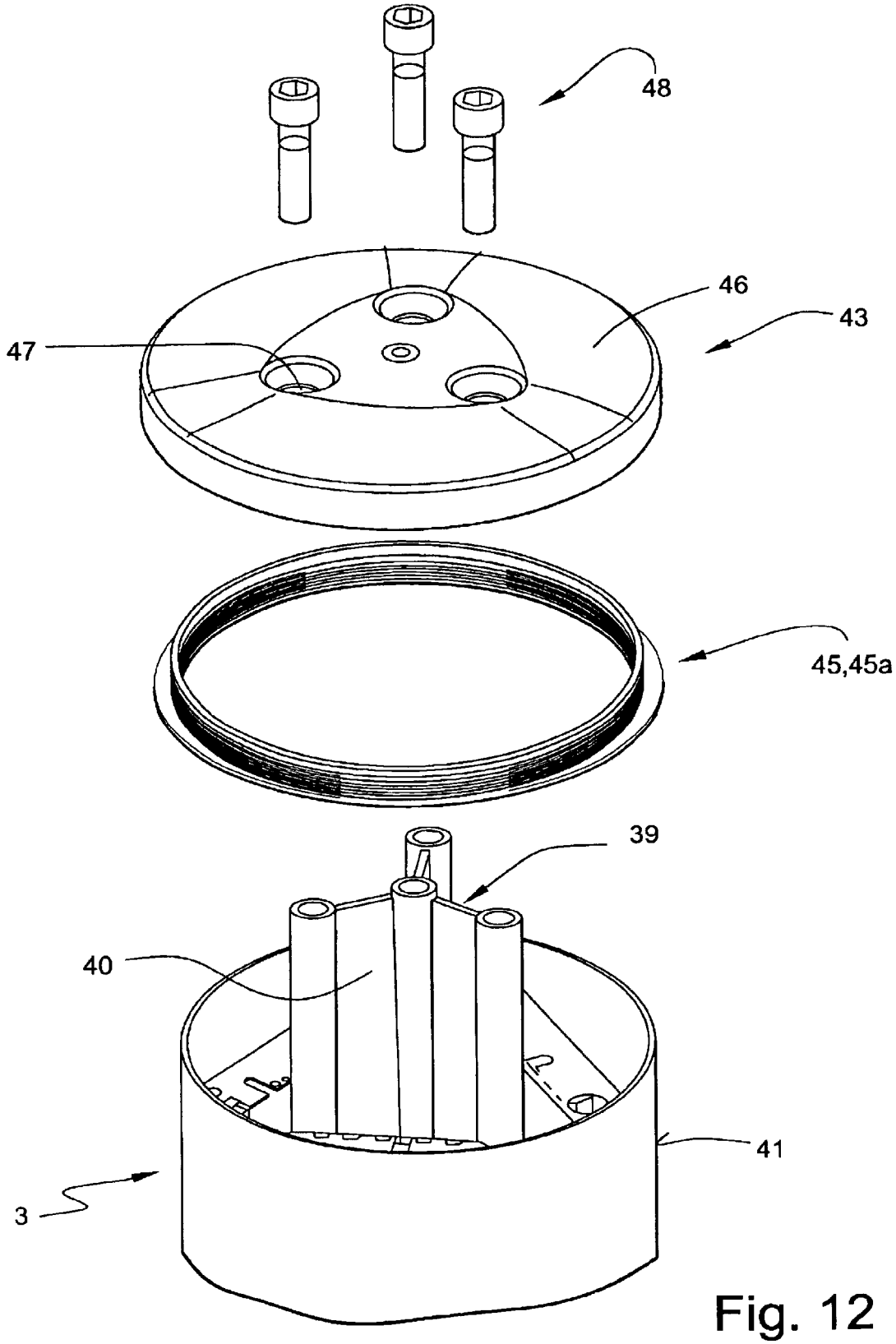
FIG. 12 shows a structure modified from that illustrated in FIG. 9, shown in the form of a vertical section.

In contrast to FIG. 9, FIG. 12 shows only that the dampening device 45 need to be provided only on the upper edge area and on the lower edge area of the radome 41, in principle, and that the pressure absorber 43, which is in the form of a cover in the illustrated exemplary illustrative non-limiting implementation, can rest firmly on the mounting core 39.

The way in which the bottom pressure absorber 43', which is in the form of a cover, is attached is in principle comparable to that of the top pressure absorber which has been mentioned and is in the form of a cover, with the major difference being that the bottom cover absorber has further aperture openings 50 through which the appropriate connecting cables and operating devices can be passed from the service zone 5.1 into the internal area within the radome 41 in the upper antenna section 3. Thus, in other words, a large number of bolts are screwed in through appropriate holes in the upper connecting ring 5.1*a*' of the service zone mount 5' from underneath in the vertical direction, to be precise into threaded holes 49 which are incorporated from underneath, running in the vertical direction, on the connecting face 3.1 which points downwards. This ensures a firm connection between the upper and lower antenna sections 3, 5.

Figure 13:
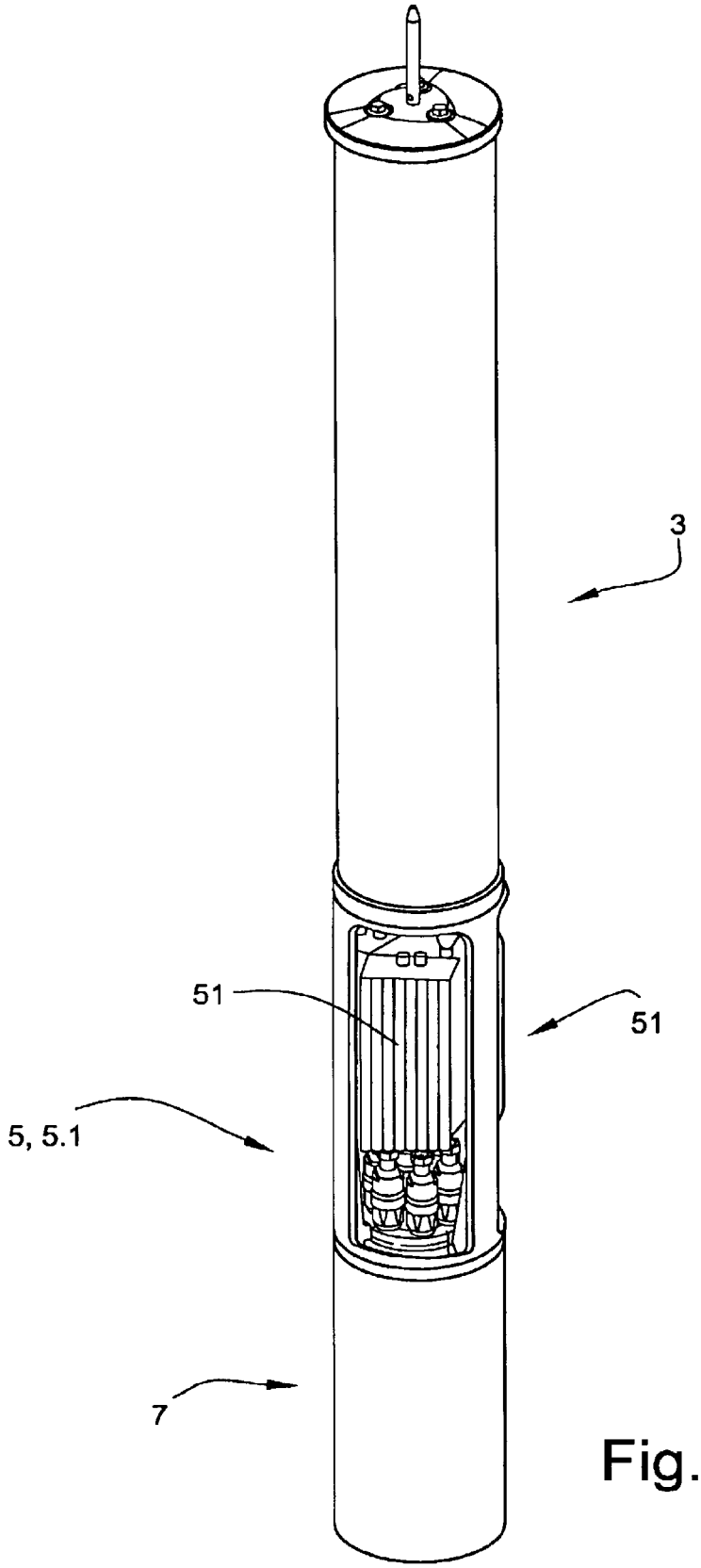
FIG. 13 shows an exemplary illustrative non-limiting implementation, comparable to FIG. 1, of a completely assembled antenna arrangement with open covers, in order to illustrate installed modules.

The components which may be required in the service zone 5.1 can now be installed in it without any problems through the access opening 35, can be replaced during repair work, or else other components can be retrofitted. In the illustrative exemplary illustrative non-limiting implementation shown in FIG. 13, therefore, three units 51 are shown which, for example, may represent amplifiers (TMA or TMB) or, for example, what are referred to as RET units which can be used to adjust and vary the down-tilt angle by remote control. Units such as these can then be used, for example, to operate an adjustment mechanism which adjusts phase shifters (which are seated underneath the radome) in order to produce desired phase shifts, such that the desired down-tilt angle can be set in this way. With regard to this method of operation, reference should in principle be made to the previously published solutions in WO 02/061877 A2 and WO 01/13459 A1, which are included in the content of the present application.

Figure 14:
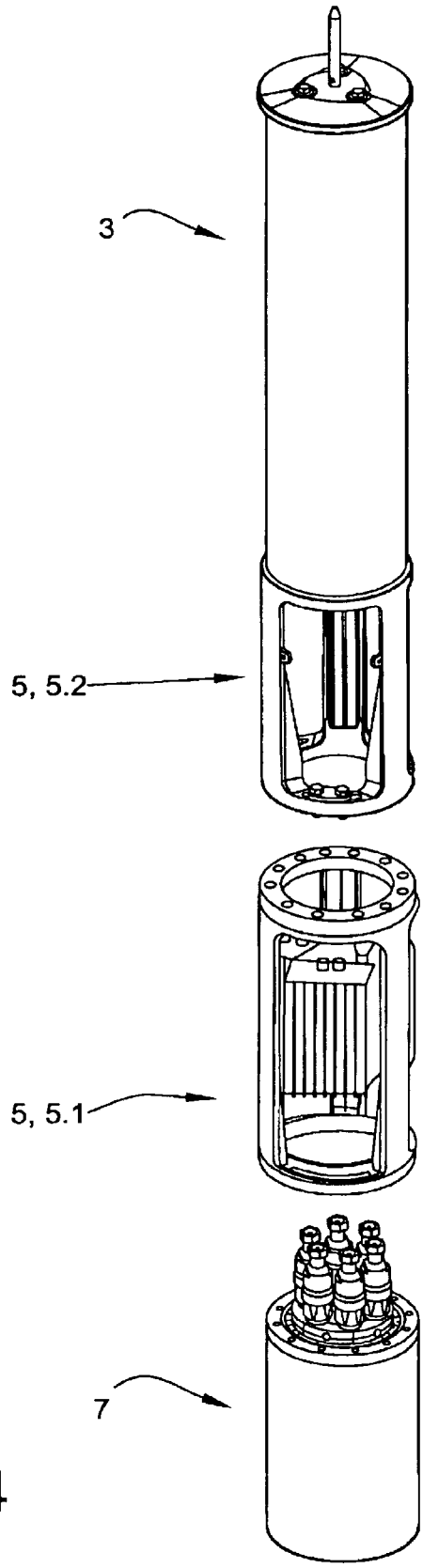
FIG. 14 shows a further exemplary illustrative non-limiting implementation to illustrate the additional fitting of a further service zone.

FIG. 14 also shows that the antenna arrangement can in principle have other service zones 5.2 etc. added to it. In this case, all the services zones—even if they are intended to have different axial lengths—are preferably designed such that at least their top and bottom connecting faces are the same, so that a further service zone 5.2 can also be connected in between them axially, for example as shown in FIG. 14.

Since removal of the covers 53 which in principle are used to close the access opening 35 allows free access to the internal areas 36 in the area of the one or more service zones, any desired connection can be produced from there from the bottom connecting ends of the cables which end there to the further connecting points, which are located on the lower face of the upper antenna section 3, of the individual antenna elements or phase shifters etc. which are located there. If required, any desired electrical/electronic assemblies can be connected in between, can be repaired, can be replaced, or can be retrofitted.

FIG. 1 indicates a cover 51' in the service zone 5.1. This may be a removable cover and/or, for example, a cover which can be pivoted outwards, preferably about a vertical rotation axis, in order to provide free access to the service zone. However, the cover may also at the same time be formed by a housing wall of an installed module 51. This makes it possible for the heat which is produced by the module to be dissipated particularly well to the outside.

This cover 51' may be smaller than the overall opening to the internal area 36 of the service zone. The cover may thus be formed in two parts, namely comprising a cover frame in which an opening is once again incorporated, in which the housing wall of the module then comes to rest as a cover closing face.

Figure 15:
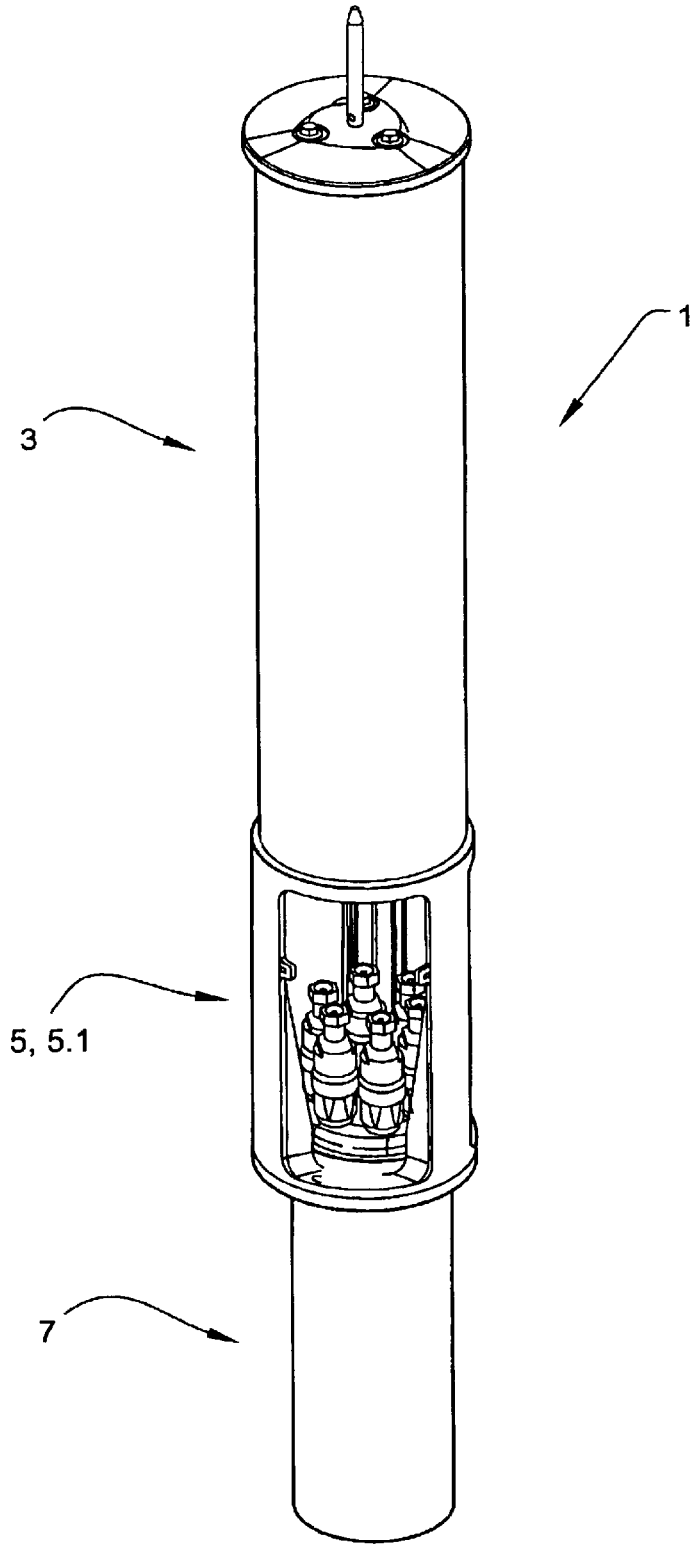
FIG. 15 shows an exemplary illustrative non-limiting implementation, once again modified, with an antenna base in the form of a pylon which has a smaller external diameter than the rest of the antenna arrangement.

FIG. 15 will now be used to show that, in principle, the shape and dimensions of the antenna base 7 may also differ, that is to say being provided with a small diameter in this exemplary illustrative non-limiting implementation. This may offer the capability to route cables upwards on the outer face of such an antenna base 7 which is in the form of a pylon, and then to pass them from underneath into the internal area 36 into the service zone 5 on the lower face of the first zone 5.1 adjacent to it.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. An antenna arrangement comprising:

a radome, a mounting core surrounded by the radome, antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section being equipped as a service zone having an internal area and at least one access opening which runs in the circumferential direction to the internal area in the service zone, the radome being held and anchored elastically via at least two damping arrangements which are offset with respect to one another.

2. Antenna arrangement according to claim 1, wherein the damping arrangements rest at least in places on the upper edge and/or on the lower edge of the external circumference of the radome.

3. Antenna arrangement according to claim 1, wherein the damping arrangements rest at least in places on the upper edge and/or on the lower edge of the internal circumference of the radome.

4. Antenna arrangement according to one of claim 1, wherein, at the upper end of the radome, the damping arrangements rest on an end face of the radome which points upwards, and/or on the end face of the radome at the lower end of the radome, which points downwards.

5. Antenna arrangement according to claim 1, wherein the damping arrangements clasp the upper and/or lower edge of the radome such that they completely surround the end face.

6. Antenna arrangement according to claim 1, wherein the service zone is in the form of a mount connected on its upper end face at least indirectly to the lower face of the upper antenna arrangement, and in that the end lower face of the mount can be mounted on an antenna base.

7. Antenna arrangement according to claim 1, wherein the mounton on the service zone has a central aperture opening on its lower end face.

8. Antenna arrangement according to claim 1, wherein the service zone comprises one or more mounts which are arranged axially one above the other and can be axially fixed to one another.

9. Antenna arrangement according to claim 1, wherein the mount on the service zone is provided on its lower contact end face with elongated holes which are located offset in the circumferential direction, the elongated holes being in the form of partial circles whose lengths are designed such that at least two bolts, which are located offset in the circumferential direction, pass through the elongated hole and can be screwed into the mounting plate located underneath said elongated hole in the antenna base or into an end-face mounting plate located underneath the elongated hole in a further service zone.

10. An antenna arrangement of the type having a radome, said antenna arrangement comprising:

a mounting core surrounded by the radome, and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein the damping arrangements are prestressed as they rest on the radome.

11. An antenna arrangement of the type including a radome, said antenna arrangement comprising:

a mounting core, is surrounded by the radome, and antenna elements for receiving and/or transmitting being arranged between the mounting core and the radome, wherein:

the antenna arrangement is subdivided at least into the upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein the damping arrangements clasp the upper and/or lower edge of the radome such that they completely surround the end face, and wherein at least one of the damping arrangements is prestressed or precompressed as it rests on the radome.

12. Antenna arrangement according to claim 11, wherein at least one of the damping arrangements is held pressed against the radome with prestressing which can be selected in advance.

13. An antenna arrangement comprising:

a mounting core, is surrounded by a radome, and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, further comprising a pressure absorber provided at the upper and/lower edge of the radome which applies pressure to the upper and/or to the lower end of the radome, with prestressing which can be selected in advance and with the interposition of the damping arrangements.

14. Antenna arrangement according to claim 13, wherein the pressure absorber which is provided at the upper and/or at the lower end of the radome has supporting shoulders, on which at least one of the damping arrangements is supported, and produces prestressing forces in the at least one damping arrangement which acts on the adjacent external circumference, on the internal circumference and/or in the axial direction on the associated end face of the radome.

15. Antenna arrangement according to claim 13, wherein at least one of the damping arrangements is also provided in the internal area of the radome, between the pressure absorber and the mounting core.

16. Antenna arrangement according to claim 13, wherein at least one of the damping arrangements is also provided between the pressure absorber and the webs which run between the mounting core and the inner face of the radome.

17. Antenna arrangement according to claim 13, wherein the pressure absorber is prestressed in the direction of the mounting core.

18. An antenna arrangement comprising:

a mounting core, is surrounded by a radome, and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein the opposite end faces of the radome are held in an elastically prestressed manner between an upper and a lower pressure absorber, with the interposition of at least one of the damping arrangements in each case, the upper and lower pressure absorbers being braced with respect to one another, via one or more tie rods which run between the two pressure absorbers.

19. An antenna arrangement comprising:

a mounting core, is surrounded by a radome, and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein at least two openings which can be closed are formed in the mount which is used as the service zone running in the circumferential direction.

20. Antenna arrangement according to claim 19, wherein the openings can be closed by covers.

21. Antenna arrangement according to claim 19, wherein the opening can be closed by use of modules which are provided in the internal area of the service zone or can be mounted there, so that at least a portion of the housing wall of one module is used as a closing cover for the opening in the service zone.

22. An antenna arrangement comprising:

a mounting core, is surrounded by a radome, said radome including a pressure absorber; and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein the lower end face and mounting face on the upper antenna arrangement is formed by the pressure absorber which is arranged at the bottom.

23. An antenna arrangement comprising:

a mounting core, is surrounded by a radome, and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein connecting points are provided in the area of the service zone and lead to the antenna elements which are accommodated in the upper antenna section, these connecting points being connected in the area of the service zone, via electrical modules and units which are accommodated there, and/or directly via connecting cables.

24. Antenna arrangement according to claim 23, wherein the connecting points are provided on cables or cable ends which are passed through the base station are held and anchored by means of strain-relief devices.

25. An antenna arrangement comprising:

a mounting core, is surrounded by a radome, and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein the service zone comprises a mount with an upper and a lower mounting plate, with the upper end face having a central section which is used as a mounting section for the mounting core.

26. An antenna arrangement comprising:

a mounting core, is surrounded by a radome, and antenna elements for receiving and/or transmitting being arranged between the mounting core and the radome, wherein:

the antenna arrangement is subdivided at least into an upper antenna section with the mounting core, the antenna elements and the radome, and at least one lower antenna section which is axially adjacent and underneath said upper antenna section, the lower antenna section is equipped as a service zone having an internal area and at least one access opening which runs in the circumferential direction to the internal area in the service zone, and the radome is held and anchored elastically via at least two damping arrangements which are offset with respect to one another, wherein widely differing antenna modules are accommodated in the internal area of the service zone, amplifiers (TMA, TMB) and units being controlled remotely in order to set different depression angles for the antenna element device.

27. An antenna having a radome, said antenna comprising:

a first antenna section comprising at least one antenna element;

a second antenna section comprising at least one further antenna element, the first and second antenna sections being commonly supported and displaced from one another, said second antenna section providing at least one circumferential access opening; and plural offset damping elements disposed in proximity to said circumferential access opening, said plural offset damping elements elastically anchoring said radome.

* * * * *